US011730264B1

(12) United States Patent
Kissel

(10) Patent No.: US 11,730,264 B1
(45) Date of Patent: Aug. 22, 2023

(54) CABINET SYSTEM

(71) Applicant: Waldemar Kissel, Gainsville, FL (US)

(72) Inventor: Waldemar Kissel, Gainsville, FL (US)

( * ) Notice: Subject to any disclaimer, the term of this patent is extended or adjusted under 35 U.S.C. 154(b) by 0 days.

(21) Appl. No.: 17/693,580

(22) Filed: Mar. 14, 2022

Related U.S. Application Data

(63) Continuation-in-part of application No. 17/194,240, filed on Mar. 6, 2021, now abandoned.

(51) Int. Cl.
*A47B 77/04* (2006.01)
*A47B 51/00* (2006.01)

(52) U.S. Cl.
CPC ..... *A47B 77/04* (2013.01); *A47B 51/00* (2013.01)

(58) Field of Classification Search
CPC ..... A47B 77/02; A47B 53/00; A47B 57/00; A47B 77/08; A47B 77/04; A47B 51/00
USPC ..... 312/107, 306, 242, 246–247, 297
See application file for complete search history.

(56) References Cited

U.S. PATENT DOCUMENTS 398,188 A * 2/1889 Rittinger ..... B65G 1/07 312/306
2,634,186 A * 4/1953 Zuss ..... A47F 3/06 312/201
2,879,124 A * 3/1959 Maxfield ..... A47B 67/02 312/242
2,885,253 A * 5/1959 Kesling ..... F25D 25/00 312/236
2,889,442 A * 6/1959 Schultz ..... F24C 15/027 219/398
3,317,259 A * 5/1967 Otis ..... E06B 9/115 160/310
3,415,586 A * 12/1968 Hammond ..... A47B 51/00 312/312
3,608,674 A * 9/1971 Phillips ..... B66B 9/00 187/270
4,397,508 A * 8/1983 Bohnet ..... A47B 77/04 126/37 R
6,755,492 B1 * 6/2004 Hyde ..... A47B 51/00 312/247
8,113,606 B2 * 2/2012 Greenberg ..... A47B 51/00 312/271
8,424,983 B1 * 4/2013 Strauss ..... A47B 51/00 312/247

(Continued)

FOREIGN PATENT DOCUMENTS

WO WO 99/62377 * 5/1998

*Primary Examiner* — Janet M Wilkens
*Assistant Examiner* — Timothy M Ayres
(74) *Attorney, Agent, or Firm* — Gulf Coast Intellectual Property Group

(57) ABSTRACT

A cabinet system that is configured to be installed in a kitchen of a residential structure wherein the cabinet system is configured to store and provide access to small electrical appliances. The cabinet system of the present invention includes a base cabinet and an upper cabinet in vertical alignment. A backboard is present between the base cabinet and upper cabinet having an opening to a recess area located behind the base cabinet and upper cabinet. A movable backboard is configured to open and close the opening. A moving cabinet is disposed within the recess area and is movable between a first position and a second position. A movement assembly is located at the top of the recess area and is operably coupled to the movable backboard and the moving cabinet.

8 Claims, 3 Drawing Sheets

(56) References Cited

U.S. PATENT DOCUMENTS

| | | | | |
|---|---|---|---|---|
| 9,801,464 | B1 * | 10/2017 | Sumners | A47B 77/04 |
| 2007/0241650 | A1 * | 10/2007 | Schmitt | A47B 51/00 312/312 |
| 2017/0290454 | A1 * | 10/2017 | Hall | A23L 5/10 |

* cited by examiner

CABINET SYSTEM

CROSS REFERENCE TO RELATED APPLICATIONS

This application is a continuation-in-part of U.S. patent application Ser. No. 17/194,240 filed, Mar. 6, 2021, entitled, Cabinet System, in the name of Waldemar Kissel, which is hereby incorporated for reference.

FIELD OF THE INVENTION

The present invention relates generally to storage cabinets, more specifically but not by way of limitation, a standalone cabinet system for kitchens that provides movable components wherein the movable components provide storage and access for small electrical appliances and further maximize the utilization of the storage space provided by the cabinet components.

BACKGROUND

As is known in the art, conventional kitchen cabinet design has been relatively unchanged for several decades. Minor improvement in cabinet design have been the norm and include but are not limited to specialized spice storage cabinets and corner optimization storage designs. Most kitchen cabinet layout designs include a lower set of cabinets that have a countertop superposed these lower cabinets. Additionally, upper cabinets are typically mounted to at least a portion of the wall above the lower cabinets and counter top area.

One issue with conventional cabinet design is the lack of ability to provide storage and easily reachable access to small electric countertop appliances. There are numerous different types of countertop appliances that are utilized in the kitchen. While some such as but not limited to coffee machines, may permanently reside on the countertop, it is generally undesirable to leave all appliances on the countertop as this can consume desired countertop space that is needed for other kitchen activities. These appliances can include but are not limited to food processors and blenders. Often an individual will store these items in cabinets for use when required. The storage of these items can often consume valuable storage space and additionally when stored individuals may not remember what appliances they have and can ultimately utilize for a desired kitchen activity.

It is intended within the scope of the present invention to provide a standalone kitchen cabinet system that provides storage and access of small appliances wherein the small appliances are stored behind a movable backboard in a recessed compartment providing efficient storage and utilization thereof.

SUMMARY OF THE INVENTION

It is the object of the present invention to provide a standalone cabinet system that is designed to provide storage and access of small electrical appliances wherein the cabinet system of the present invention includes a recessed area configured to accommodate a double cabinet configuration.

Another object of the present invention is to provide a kitchen cabinet system that is operable to provide storage and access of a plurality of electrical appliances wherein the double cabinet configuration is oriented in a vertical configuration in a recessed plenum area behind the customary base cabinet.

Still another object of the present invention is to provide a kitchen cabinet system that is operable to provide storage and access of a plurality of electrical appliances wherein the recessed area has a backboard element that is in a position to cover the opening of the double cabinet configuration.

An additional object of the present invention is to provide a standalone cabinet system that is designed to provide storage and access of small electrical appliances wherein the cabinet system of the present invention wherein the backboard element is located where a conventional backsplash for a standard kitchen design is located.

Yet a further object of the present invention is to provide a kitchen cabinet system that is operable to provide storage and access of a plurality of electrical appliances wherein the backboard is movable in an upward position.

Another object of the present invention is to provide a standalone cabinet system that is designed to provide storage and access of small electrical appliances wherein the cabinet system of the present invention provides access to the upper cabinet of the double cabinet configuration when the backboard is moved in an upward direction.

An alternate object of the present invention is to provide a kitchen cabinet system that is operable to provide storage and access of a plurality of electrical appliances wherein the lower cabinet of the double cabinet configuration is movable in an upward and downward direction.

Still a further object of the present invention is to provide a standalone cabinet system that is designed to provide storage and access of small electrical appliances wherein the double cabinet configuration is movable.

A further object of the present invention is to provide a kitchen cabinet system that is operable to provide storage and access of a plurality of electrical appliances wherein the lower cabinet of the double cabinet configuration is moved in an upwards and downwards direction utilizing a lifting element such as but not limited to an electric motor.

An alternative objective of the present invention is to provide a standalone cabinet system that is designed to provide storage and access of small electrical appliances wherein the double cabinet configuration includes movable shelves that are configured to extend outward so as to provide access to appliances superposed thereon.

Another object of the present invention is to provide a kitchen cabinet system that is operable to provide storage and access of a plurality of electrical appliances wherein the double cabinet configuration is configured with electrical supplies so as to electrically couple appliances to a power source while stored on the movable shelves.

Yet a further object of the present invention is to provide a standalone cabinet system that is designed to provide storage and access of small electrical appliances wherein the upper and lower cabinet of the double cabinet configuration can be provided in various sizes.

Still an additional object of the present invention is to provide a kitchen cabinet system that is operable to provide storage and access of a plurality of electrical appliances wherein the present invention further includes track jambs with a front side having three channels.

Another object of the present invention is to provide a standalone cabinet system that is designed to provide storage and access of small electrical appliances that further includes vertical strips that guide the movement of the double cabinet configuration.

Still a further object of the present invention is to provide a kitchen cabinet system that is operable to provide storage and access of a plurality of electrical appliances in a double cabinet configuration wherein both the upper and lower compartments are impervious to insects and rodents.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

and

Figure 3:
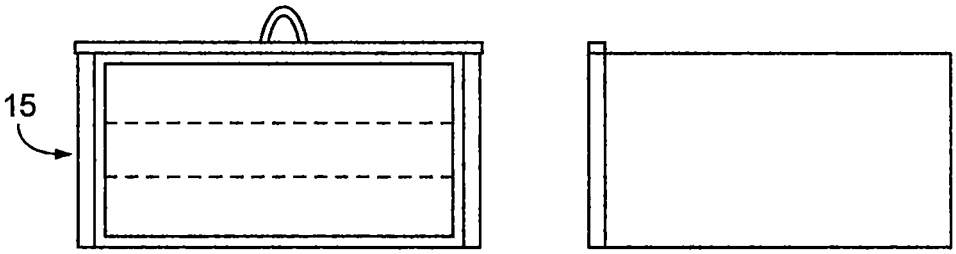
Figure 4:
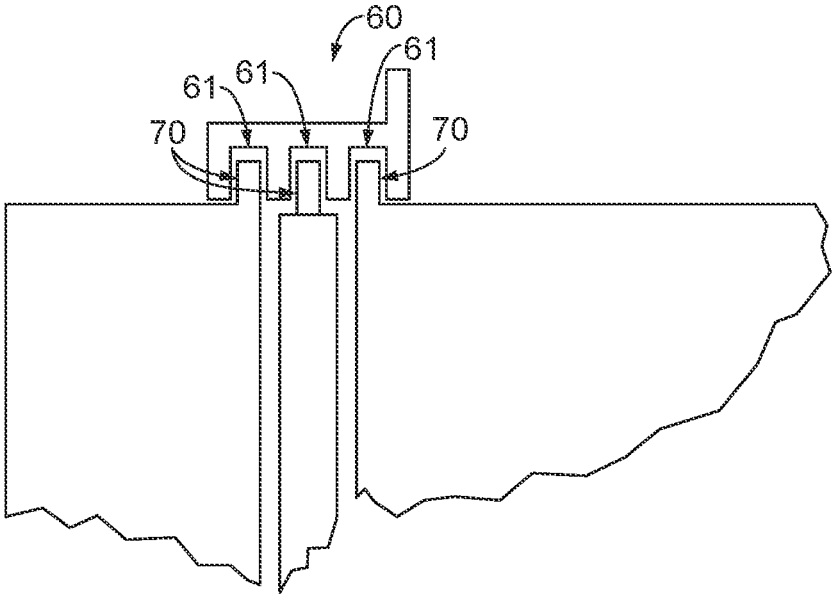
Figure 5:
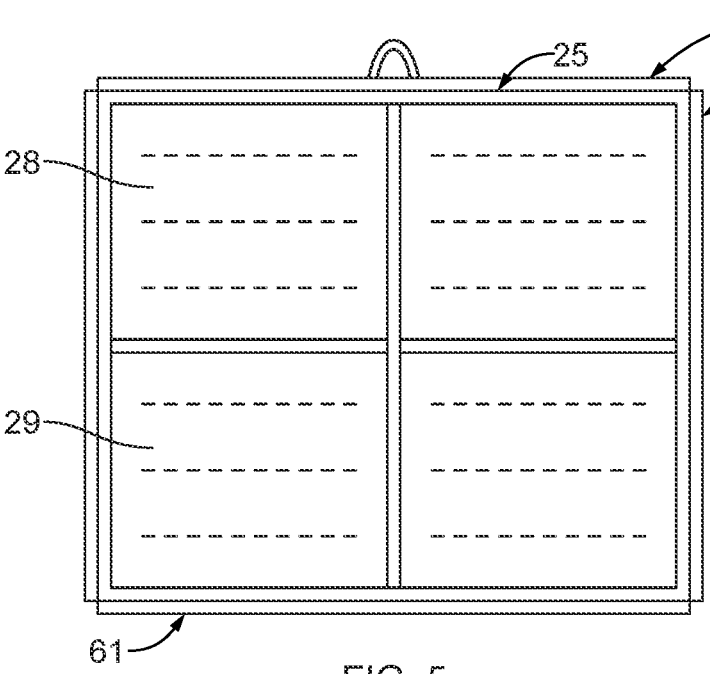
Figure 6:
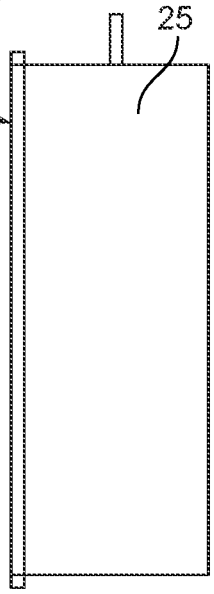
Figure 7:
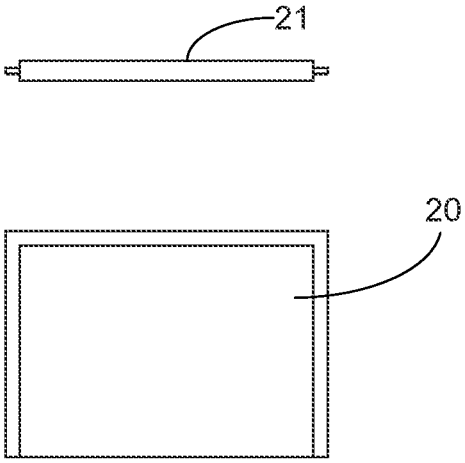
Figure 8:
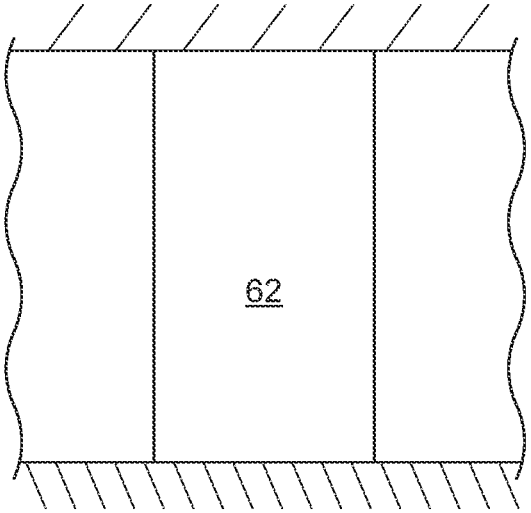
Figure 9:
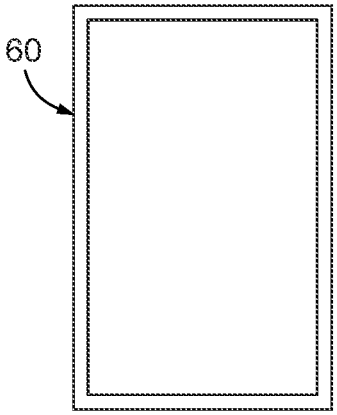

FIG. 3 is a front view of an exemplary upper level front cabinet of the present invention; and FIG. 4 top detailed view of the track assembly of the present invention; and FIG. 5 is a front view of an exemplary embodiment of the moving double cabinet configuration of the present invention; and FIG. 6 is a side view of the exemplary embodiment of the moving double cabinet configuration of the present invention; and FIG. 7 is a front and top view of the backplate of the present invention; and FIG. 8 is a front view of an exemplary rough opening in kitchen framing; and FIG. 9 is a view of the frame of the present invention having three grooves.

DETAILED DESCRIPTION

Referring now to the drawings submitted herewith, wherein various elements depicted therein are not necessarily drawn to scale and wherein through the views and figures like elements are referenced with identical reference numerals, there is illustrated a cabinet system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
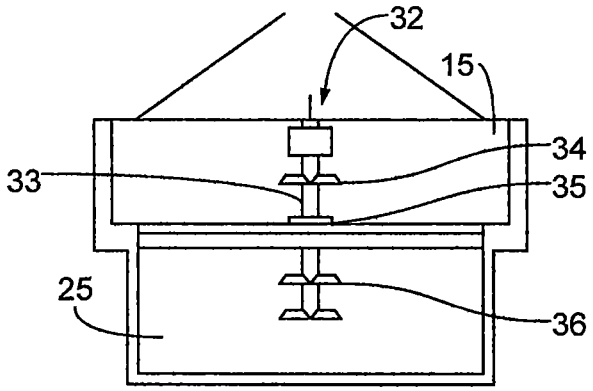
FIG. 1 is a top view of an exemplary cabinet system of the present invention.

Referring to the Figures submitted as a part hereof, the cabinet system 100 includes a base cabinet 10, an upper cabinet 15, a movable backboard 20 and a moving cabinet 25. The cabinet system 100 further includes a movement assembly 30 wherein the movement assembly 30 includes a motor 32 and axle 33 have pulleys 34 operably coupled thereto with independently operable electromagnetic clutches. The exemplary installation illustrated herein in FIG. 1 does not serve to limit how the cabinet system 100 can be installed and is illustrated herein for demonstration purposes only. It should be understood within the scope of the present invention that the cabinet system 100 can include a plurality of configurations and sizes based on the desired size in which a user wishes to have installed into an area such as but not limited to a kitchen.

It is contemplated within the scope of the present invention that the base cabinet 10 can be constructed of various suitable materials. It should be further understood that while the base cabinet 10 of the present invention is constructed in a conventional height for an area such as but not limited to a kitchen, that the base cabinet 10 could be constructed in alternate heights. The base cabinet 10 can be configured to be secured to floor on, which it is superposed. It should be understood within the scope of the present invention that the cabinet system 100 could have alternate quantities of base cabinets 10.

The cabinet system 100 includes at least one upper cabinet 15. The upper cabinet 15 includes a plurality of walls 16, a bottom 17 and a top 18 that are operably coupled to form an interior volume. The upper cabinet 15 is positioned above the base cabinet 10 and is secured in position with a suitable cable and pulley attached to lifting. The upper cabinet 15 is mounted above the base cabinet 10 so as to leave a space for backboard. It should be understood within the scope of the present invention that the upper cabinet 15 can be mounted at alternate heights above the base cabinet 10. However, the minimum height from the bottom of the upper cabinet to the top of the countertop must be equal to the height of the top countertop above the floor. Furthermore, it should be understood within the scope of the present invention that the upper cabinet 15 can be manufactured in alternate sizes.

Figure 2:
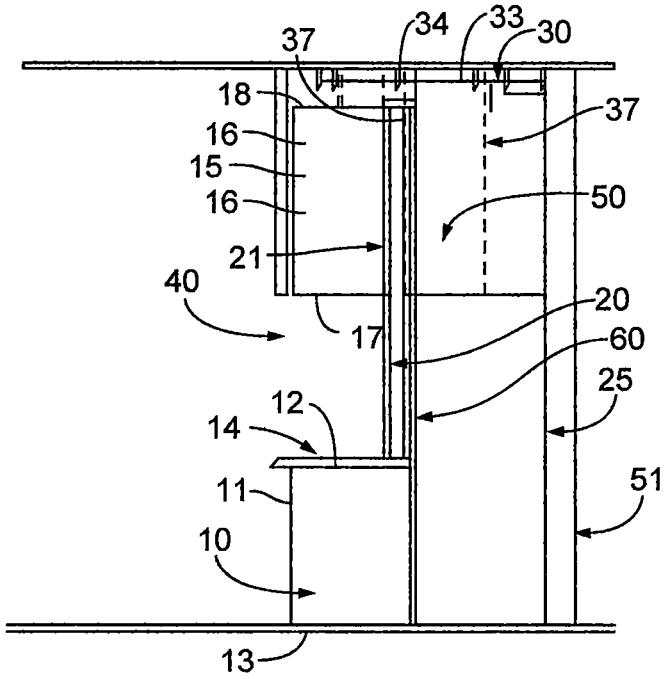
FIG. 2 is a side view of the cabinet system of the present invention.

The cabinet system 100 includes an out of site plenum area 50 wherein the plenum area 50 is defined as a space between back wall 51, the backboard 20 and the base cabinet 10 and upper cabinet 15. The plenum area 50 is required for the moving cabinet 25. As will be further discussed herein the moving cabinet 25 is movable at any elevation a first position a maximum second position. The plenum area 50 is constructed to a size so as to accommodate a moving cabinet 25 therein. It should be understood within the scope of the present invention that the plenum area 50 is accessible for working purposes ensuing the movable backboard 20 being moved to its second position 21. The movable backboard 20 has a first position and a second position 21. In its first position the movable backboard 20 is positioned as is shown herein in FIG. 2 wherein this position inhibits access to the plenum area 50 and as such the movable cabinet 25. The movable backboard 20 is constructed of a suitable material such as but not limited to cement board and it should be understood within the scope of the present invention that the movable backboard 20 could have secured thereto a decorative layer such as but not limited to tile. In its second position 21, the movable backboard 20 is moved upwards so as to be adjacent the upper cabinet 15 so as to allow access to the plenum area 50 and as such the movable cabinet 25 disposed therein. The cabinet 50 is controlled so it cannot move to a first or second position if the movable backboard 20 is in its second position. The plenum area 50 must be three times the height of the top of the countertop plus a vertical allowance of the movement assembly 30.

The cabinet system 100 further includes a movement assembly 30. The movement assembly 30 is operable to move the moving cabinet 25 between alternate positions so as to provide access to the interior volume thereof. Additionally, the movement assembly 30 is operably coupled to the movable backboard 20 wherein the movement assembly 30 facilitates the movement of the movable backboard 20 between a first and second position. Additionally, the movement assembly 30 is operably coupled to the movable upper cabinet 15 wherein the movement assembly 30 facilitates the movement of upper cabinet 15 between a second and first position. The movement assembly 30 includes a motor 32 wherein the motor 32 is operably coupled to an axle 33 having pulleys 34, 35 and 36 secured thereto. The motor 32 functions to rotate the axle 33 and pulley 34 so as to facilitate the movement of the moving cabinet 25 utilizing cables 37 secured to pulleys 34. It should be understood within the scope of the present invention that the movement assembly 30 and pulleys 34,35 and 36 are activated by clutches and actuators located at pulleys 34,35 and 36 to facilitate independent movement of the moving cabinet 25, movable backboard 20 and upper cabinet 15. While the movement assembly 30 is disclosed having a particular embodiment, it is contemplated within the scope of the present invention that the movement assembly 30 could be comprised of alternate and/or additional components in order to accomplish the desired objective discussed herein.

Referring in particular to FIG. 9, the cabinet system 100 includes a track assembly 60. The track assembly 60 is mounted within the rough opening 62, illustrated herein in FIG. 8 utilizing suitable fasteners and is vertically and horizontally adjacent to moving backboard 20, the movable cabinet 25 and base cabinet 10. The track assembly 60 extends from the floor up to a height three times the top of the countertop above the floor. The rough opening 62 extends floor to ceiling and is as wide as the width of the moving cabinet 25 plus allowance for fastening the track assembly 60. The track assembly 60 includes a plurality of grooves 61 wherein the grooves 61 are operably to engage protrusions 70. The protrusions 70 are formed on the front edge of the moving cabinet 25 and the movable backboard 20 and the back edge of the upper cabinet 15. The track assembly 60 is installed along side, top and bottom of rough opening 62 to the plenum area 50 and functions to ensure that the movement of the moving cabinet 25, movable backboard 20 and upper cabinet 15 does not have any backwards-forwards motion while traversing in a vertical direction and further provides an insect and rodent barrier into cabinet 25.

Illustrated herein in FIG. 5 is a front view of an exemplary movable cabinet 25 with protrusions 70. The exemplary embodiment illustrated in FIG. 5 provides the ability to have a first level 28 and a second level 29. In this embodiment the movable cabinet 25 can be moved to a first position, second position or a third position or any intermediate position wherein a user can have different appliances on the first level 28 and second level 29. While two levels have been illustrated herein, it should be understood within the scope of the present invention that the moving cabinet 25 could have as few as one level or more than two in order to provide the capability to store alternate appliances and varying quantities thereof. It is further contemplated within the scope of the present invention that the moving cabinet 25 has disposed therein conventional receptacles so as to provide the necessary electric power to the appliances stored therein. Receptacles are mounted inside the cabinet to a junction box flexibly attached to a receptacle on wall 51.

When operating the cabinet system 100 the operator selects appropriate setting of control switch 14. Activating position "A" raises the backboard 20, lights and electricity is turned on in the first level 28 of moving cabinet 25. Activating position "B" raises the cabinet 25 to a position 2 along with moving backboard 20 to position two, then electricity and lights are activated. Reversing to position "A" and backboard 20 will return to position one, only then can movable cabinet 25 return to position one and then backboard 20 can raise up to position two 21 allowing access to the second level 28 of movable cabinet 25. Activate position "C" and the upper cabinet descends from position two to positions one resting on top of countertop. Contact switches are attached to a signal to a controller the position of the cabinet 25 and backboard 20. The operator can switch the controller to indicate the desired position. When the second level 28 is desired the backboard 20 comes on and lights up. When the first level 29 is preferred the backboard 20 must be all the way down, then the movable cabinet 25 is raised and the backboard 20 can be raised and lights turned on and receptacles activated. If the upper front cabinet box is desired, it can move up or down as long as the backboard 20 is down.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A standalone cabinet system comprising:

a base cabinet, a movable upper cabinet and a movable cabinet, wherein the movable cabinet includes a lower section and an upper section located behind said base cabinet and a backboard in an opening, said opening extending floor to ceiling and having a width slightly greater than a width of the movable cabinet, wherein the standalone cabinet system includes a track assembly, said track assembly extending from a floor up to a height three times greater than a height of a countertop superposed the base cabinet, said track assembly including a plurality of grooves, said track assembly being installed along a side, a top and a bottom of the opening, said backboard being movable, said backboard being mounted in a plane with and between a back of the base cabinet and a back of movable upper cabinet, said movable upper cabinet located above said base cabinet, said backboard having a lower position and an upper position, said movable cabinet having a lower position and an upper position, wherein a front edge of the movable cabinet has a protrusion formed thereon extending an entire length thereof, said backboard having a protrusion formed on a front edge thereof extending an entire length thereof, said upper cabinet having a protrusion formed on a back edge thereof extending an entire length thereof, wherein said protrusions maintain engagement with said plurality of grooves of said track assembly;

a guide frame, said guide frame having grooves for guiding said backboard, said movable cabinet and said movable upper cabinet in an up and down direction; and a movement assembly, said movement assembly further including an electric motor, cables, controls and contact sensors.

2. The standalone cabinet system as recited in claim 1, wherein the lower section of the movable cabinet in its lower position is located behind and adjacent to said base cabinet, said upper section of the movable cabinet in its lower position being located directly behind the movable backboard in the lower position.

3. The standalone cabinet system as recited in claim 1, wherein said lower section of the movable cabinet in its upper position is located directly behind the movable backboard in the lower position, said upper section of the movable cabinet in the upper position is located directly behind the upper cabinet.

4. The standalone cabinet system as recited in claim 2, wherein the upper section of the movable cabinet and movable upper cabinet in the lower position wherein the backboard is in the lower position inhibits access to the upper section of the movable cabinet, wherein when the backboard is raised to the upper position and the movable cabinet and movable upper cabinet remain in the lower position access is available to the upper section of the movable upper cabinet and movable cabinet.

5. The standalone cabinet system as recited in claim 3, wherein the lower section of movable upper cabinet and movable cabinet in the upper position and with the backboard in the lower position access to the lower section of the movable upper cabinet and movable cabinet is inhibited and wherein when said backboard is moved to the upper position access is provided to the lower section of the movable upper cabinet and movable cabinet.

6. The standalone cabinet system as recited in claim 1, wherein the standalone cabinet system does not break a plane of a floor or ceiling in a location wherein the standalone cabinet system is installed.

7. The standalone cabinet system as recited in claim 1, wherein installation of the standalone cabinet system does not require additional framing or structural changes to a building in which the standalone cabinet system is installed.

8. The standalone cabinet system as recited in claim 1, wherein the standalone cabinet system requires a minimum ceiling height at least three times as high as a top of a base countertop plus additional height to accommodate the movement assembly and wherein the height of the base cabinet and backboard are equal, and a space above said backboard must be at least as high as the backboard plus sufficient clearance for location of the movement assembly.

* * * * *